US011664148B2

(12) United States Patent
Yoon et al.

(10) Patent No.: US 11,664,148 B2
(45) Date of Patent: May 30, 2023

(54) COIL COMPONENT

(71) Applicant: SAMSUNG ELECTRO-MECHANICS CO., LTD., Suwon-si (KR)

(72) Inventors: Chan Yoon, Suwon-si (KR); Young Ghyu Ahn, Suwon-si (KR); Dong Hwan Lee, Suwon-si (KR); Dong Jin Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 701 days.

(21) Appl. No.: 16/539,658

(22) Filed: Aug. 13, 2019

(65) Prior Publication Data

US 2020/0286673 A1 Sep. 10, 2020

(30) Foreign Application Priority Data

Mar. 6, 2019 (KR) ..... 10-2019-0025796

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/255* (2013.01); *H01F 27/29* (2013.01); *H01F 27/32* (2013.01); *H01F 2027/2809* (2013.01)

(58) Field of Classification Search
CPC ..... H10F 27/2804
(Continued)

(56) References Cited

U.S. PATENT DOCUMENTS 6,710,694 B2 3/2004 Matsuta et al.
7,259,648 B2 8/2007 Matsutani et al.
(Continued)

FOREIGN PATENT DOCUMENTS

JP 5-121255 A 5/1993
JP 11-54336 A 2/1999
(Continued)

OTHER PUBLICATIONS

Lee, Jong-Pil et al., "Analysis and Design of Coupled Inductors for Two-Phase Interleaved DC-DC Converters", Journal of Power Electronics, vol. 13, No. 3, May 2013, pp. 339-348.
(Continued)

*Primary Examiner* — Ronald Hinson
(74) *Attorney, Agent, or Firm* — Morgan, Lewis & Bockius LLP

(57) ABSTRACT

A coil component includes a body; a first coil portion disposed inside of the body and having a first core portion; a first external electrode and a second external electrode disposed outside of the body and connected to both ends of the first coil portion, respectively; a second coil portion disposed on the first coil portion in the body and having a second core portion; and a third external electrode and a fourth external electrode disposed outside of the body and connected to both ends of the second coil portion, respectively, wherein the first core portion comprises a first shared core portion overlapping the second core portion and a first non-shared core portion not overlapping the second core portion, and the second core portion comprises a second shared core portion overlapping the first core portion and a second non-shared core portion not overlapping the first core portion.

18 Claims, 9 Drawing Sheets

(51) Int. Cl.
*H01F 27/29* (2006.01)
*H01F 27/32* (2006.01)
*H01F 27/255* (2006.01)

(58) Field of Classification Search
USPC ..... 336/200
See application file for complete search history.

(56) References Cited

U.S. PATENT DOCUMENTS

| | | | | |
|---|---|---|---|---|
| 9,655,247 | B1 | 5/2017 | Yoon et al. | |
| 9,892,841 | B2 | 2/2018 | Choi | |
| 2003/0076211 | A1* | 4/2003 | Matsuta | H01F 27/2804 336/200 |
| 2006/0145804 | A1* | 7/2006 | Matsutani | H01F 27/292 336/200 |
| 2016/0042860 | A1 | 2/2016 | Choi | |
| 2016/0078986 | A1* | 3/2016 | Yoon | H01F 3/00 336/83 |
| 2016/0217917 | A1 | 7/2016 | Jeong | |
| 2016/0379746 | A1 | 12/2016 | Yoshioka et al. | |
| 2017/0150608 | A1 | 5/2017 | Yoon et al. | |
| 2017/0316865 | A1* | 11/2017 | Sheng | H01F 27/245 |
| 2018/0240586 | A1 | 8/2018 | Yoon et al. | |

FOREIGN PATENT DOCUMENTS

| | | | |
|---|---|---|---|
| JP | 2003-133135 | A | 5/2003 |
| JP | 2015-019100 | A | 1/2015 |
| JP | 6287974 | B2 | 2/2018 |
| JP | 2018-137421 | A | 8/2018 |
| KR | 10-2005-0011090 | A | 1/2005 |
| KR | 10-1565705 | B1 | 11/2015 |
| KR | 10-2016-0032580 | A | 3/2016 |
| KR | 10-2016-0092674 | A | 8/2016 |
| KR | 10-2017-0058599 | A | 5/2017 |
| WO | 2004/055841 | A1 | 7/2004 |
| WO | 2017-199837 | A | 11/2017 |

OTHER PUBLICATIONS

Japanese Office Action dated Nov. 15, 2022, issued in corresponding Japanese Patent Application No. 2019-147014.

Korean Office Action dated Mar. 1, 2023, issued in corresponding Korean Patent Application No. 10-2019-0025796 with English tranlsation.

* cited by examiner

COIL COMPONENT

CROSS-REFERENCE TO RELATED APPLICATION

This application claims the benefit of priority to Korean Patent Application No. 10-2019-0025796 filed on Mar. 6, 2019 in the Korean Intellectual Property Office, the disclosure of which is incorporated herein by reference in its entirety.

TECHNICAL FIELD

The present disclosure relates to a coil component.

BACKGROUND

With the miniaturization and thinning of electronic devices such as digital TVs, mobile phones, notebook PCs and the like, coil components applied to such electronic devices are required to be downsized and thinned. In order to meet such needs, research and development of various coiled type or thin film type coil components are actively proceeding.

The major issue in the miniaturization and thinning of coil components is to realize the same characteristics as existing coil components, despite such miniaturization and thinning. In order to satisfy such a demand, it is necessary to increase the filling ratio of the magnetic material in the core filled with the magnetic material. However, there is a limit to increasing the ratio of the magnetic material, due to the strength of the inductor body, the change of the frequency characteristics depending on the insulating properties, and the like.

There is increasing demand for array type components having the advantage of reducing the mounting area of coil components. Such array type coil components may have a non-coupled or coupled inductor form or a mixed form thereof, depending on a coupling coefficient or a mutual inductance between a plurality of coil portions.

In the coupled inductor, leakage inductance may be related to output current ripple, and mutual inductance may be related to inductor current ripple. For the coupled inductor to have the same output current ripple as an existing non-coupled inductor, the leakage inductance of the coupled inductor should be equal to the inductance of a conventional non-coupled inductor. When the mutual inductance increases, the coupling coefficient (k) may increase, thereby reducing the inductor current ripple.

Therefore, when a coupled inductor having the same size as the existing non-coupled inductors has the same output current ripple as the conventional non-coupled inductor and reduces the inductor current ripple, the efficiency may increase without an increase in the mounting area. In order to increase the efficiency of the inductor array chip while maintaining the chip size, a coupled inductor having a large coupling coefficient by increasing mutual inductance may be needed. On the other hand, depending on the needs of the application, coupled inductors having a relatively low coupling coefficient may be required, in which case the coupling coefficient between the coil portions needs to be reduced to an appropriate level.

SUMMARY

An aspect of the present disclosure is to effectively control the coupling inductance between coil portions in a coil component having a coupled inductor structure.

According to an aspect of the present disclosure, a coil component includes a body; a first coil portion disposed inside of the body and having a first core portion; a first external electrode and a second external electrode disposed outside of the body and connected to both ends of the first coil portion, respectively; a second coil portion disposed on the first coil portion in the body and having a second core portion; and a third external electrode and a fourth external electrode disposed outside of the body and connected to both ends of the second coil portion, respectively, wherein the first core portion comprises a first shared core portion overlapping the second core portion and a first non-shared core portion not overlapping the second core portion, and the second core portion comprises a second shared core portion overlapping the first core portion and a second non-shared core portion not overlapping the first core portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
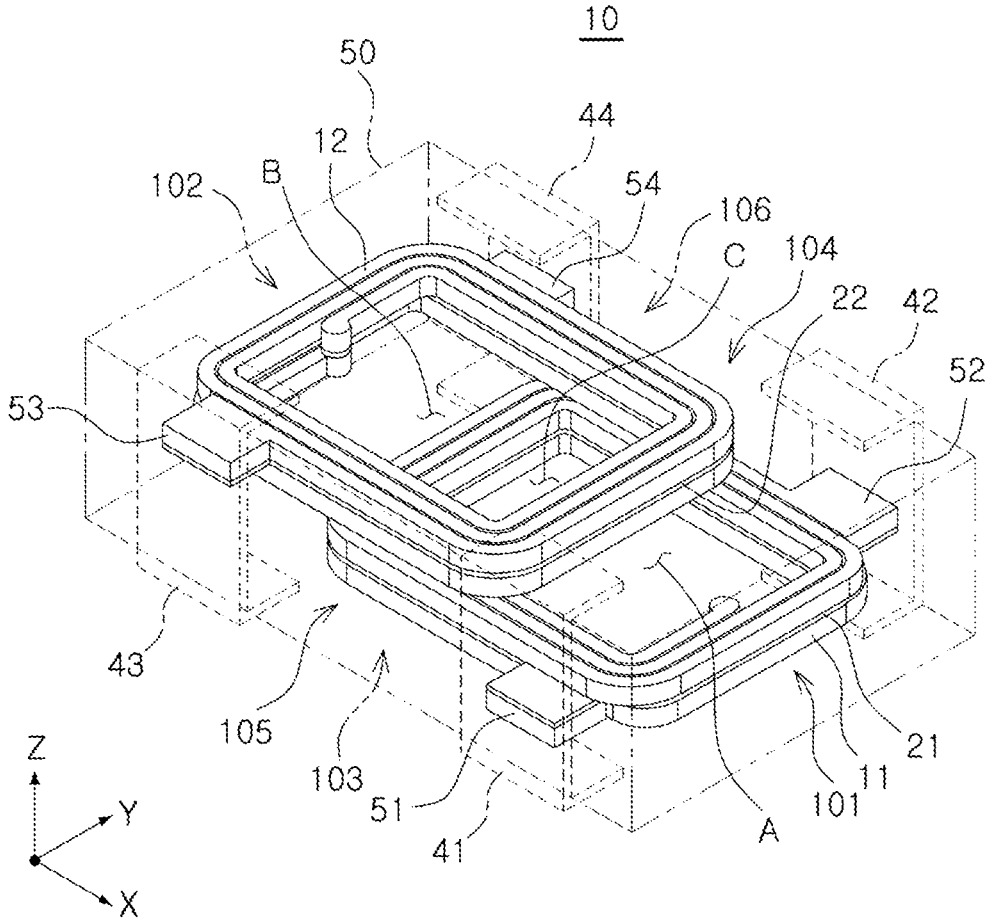
FIG. 1 is a transmission perspective view schematically illustrating a coil portion according to an embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an X direction is a first direction or a length direction, a Y direction is a second direction or a width direction, a Z direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Thin Film Type Coil Component

First Embodiment

FIG. 1 is a transmission perspective view schematically illustrating a coil portion according to an embodiment of the present disclosure.

Figure 2:
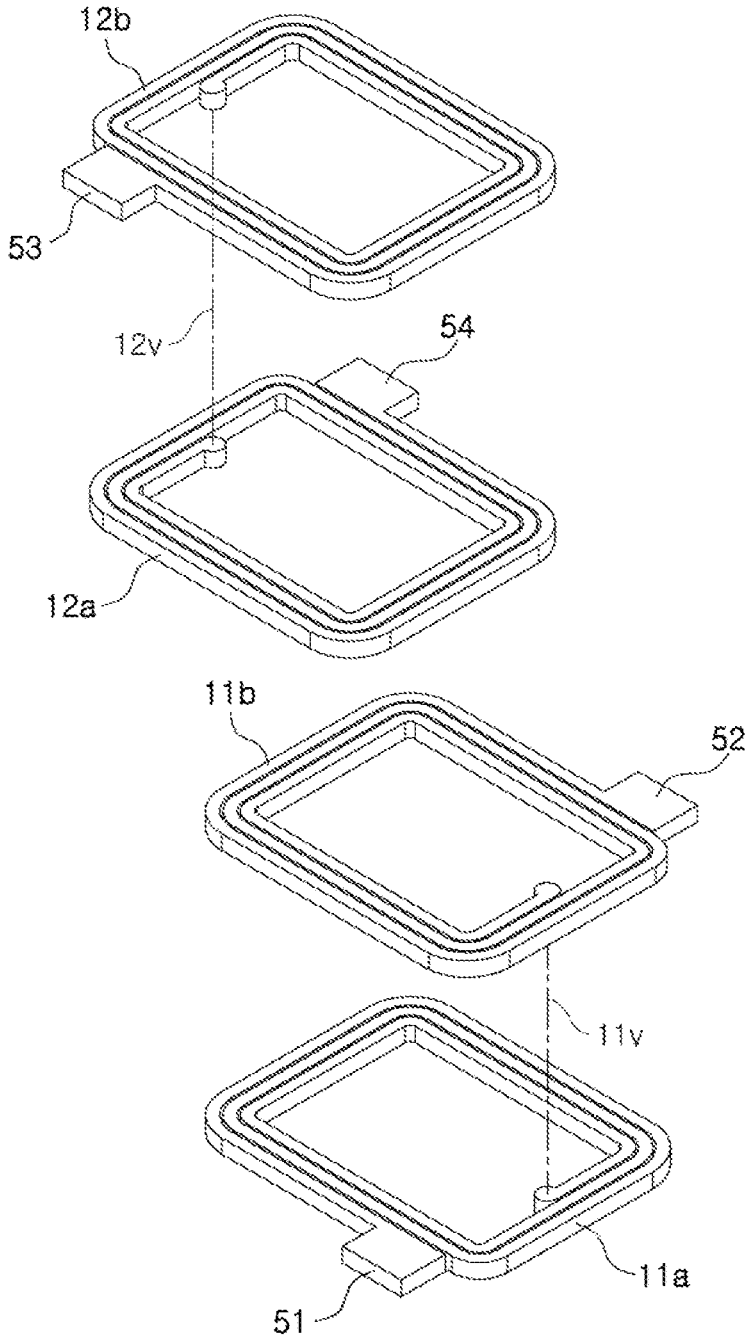
FIG. 2 is an exploded perspective view illustrating a coil portion included in the coil component of FIG. 1.

FIG. 2 is an exploded perspective view illustrating a coil portion included in the coil component of FIG. 1.

Figure 3:
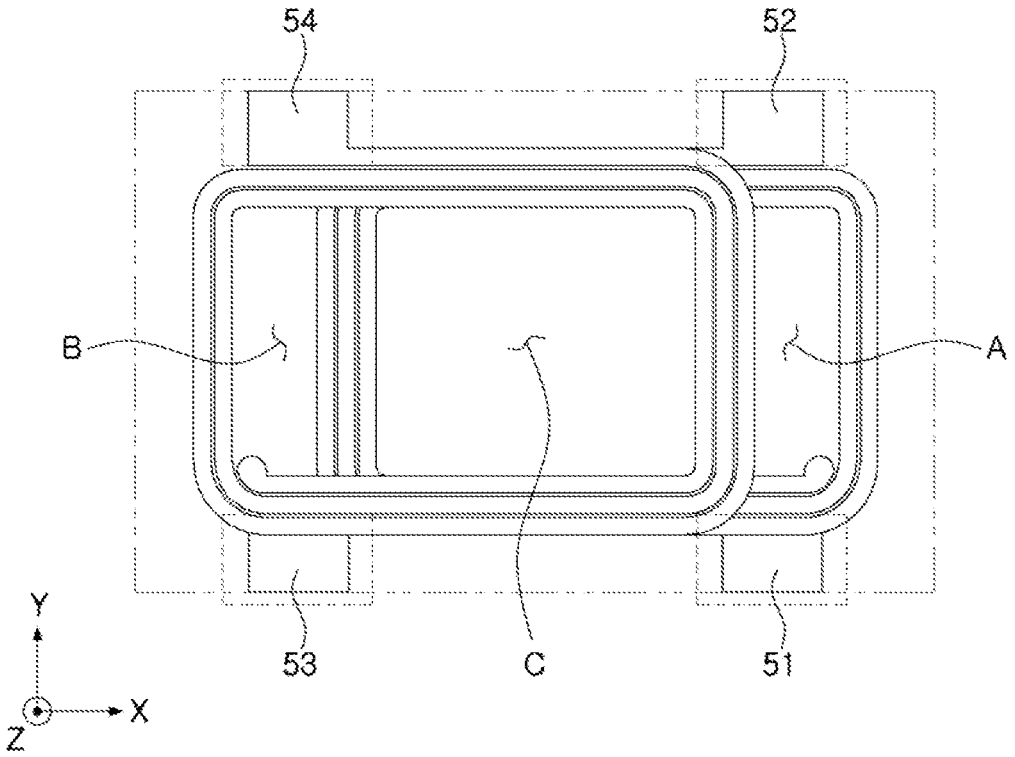
FIG. 3 is a cross-sectional view illustrating a core portion included in the coil component of FIG. 1.

FIG. 3 is a cross-sectional view illustrating a core portion included in the coil component of FIG. 1.

Figure 4:
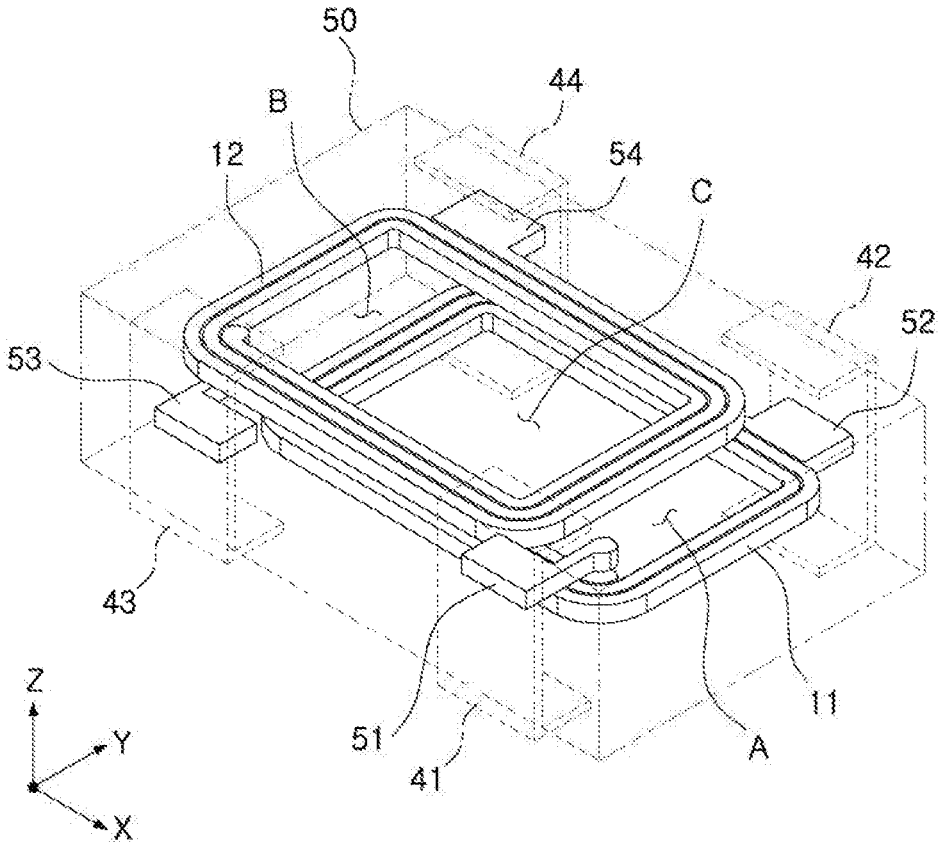
FIG. 4 is a transmission perspective view schematically illustrating a coil portion according to an embodiment of the present disclosure.

FIG. 4 is a transmission perspective view schematically illustrating a coil portion according to an embodiment of the present disclosure.

Figure 5:
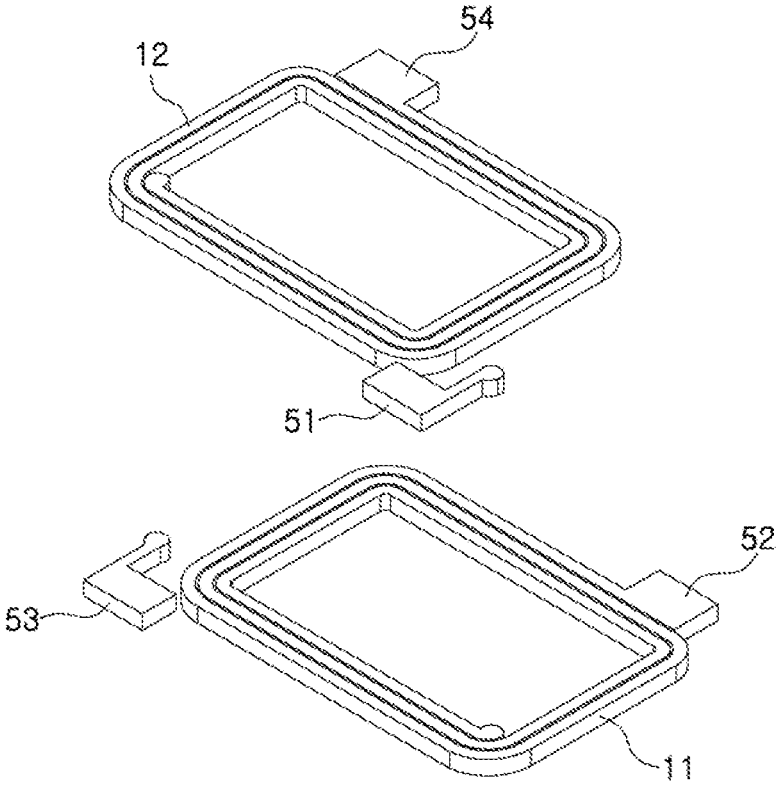
FIG. 5 is an exploded perspective view illustrating a coil portion included in the coil component of FIG. 4.

FIG. 5 is an exploded perspective view illustrating a coil portion included in the coil component of FIG. 4.

Figure 6:
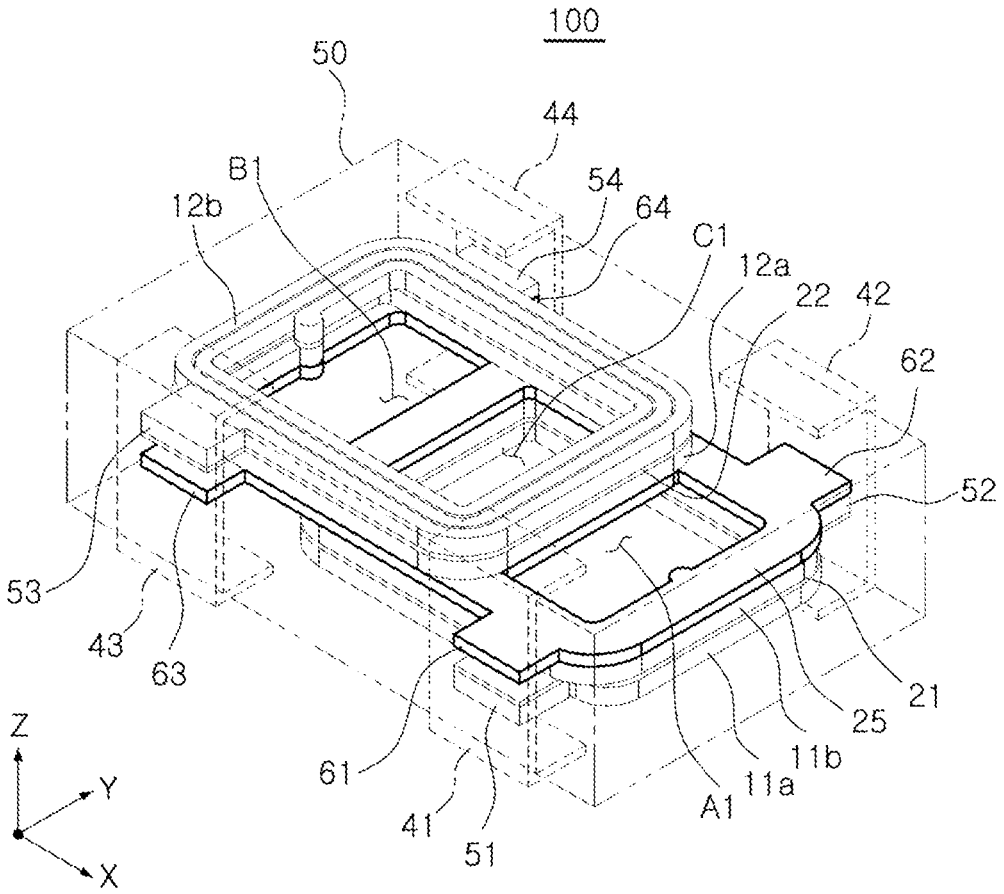
FIG. 6 is a transmission perspective view schematically illustrating a coil portion according to a modified embodiment of an embodiment of the present disclosure.

FIG. 6 is a transmission perspective view schematically illustrating a coil portion according to a modified embodiment of an embodiment of the present disclosure.

Figure 7:
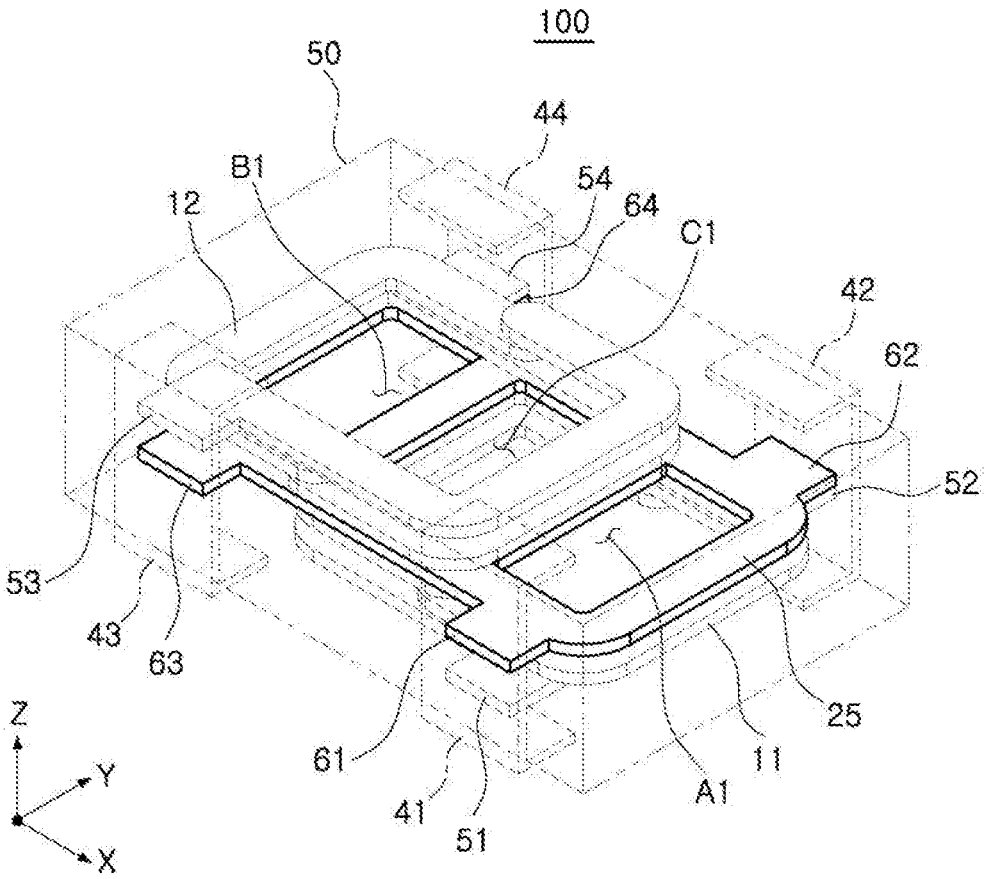
FIG. 7 is a transmission perspective view schematically illustrating a coil portion according to a modified embodiment of an embodiment of the present disclosure.

FIG. 7 is a transmission perspective view schematically illustrating a coil portion according to a modified embodiment of an embodiment of the present disclosure.

Figure 8:
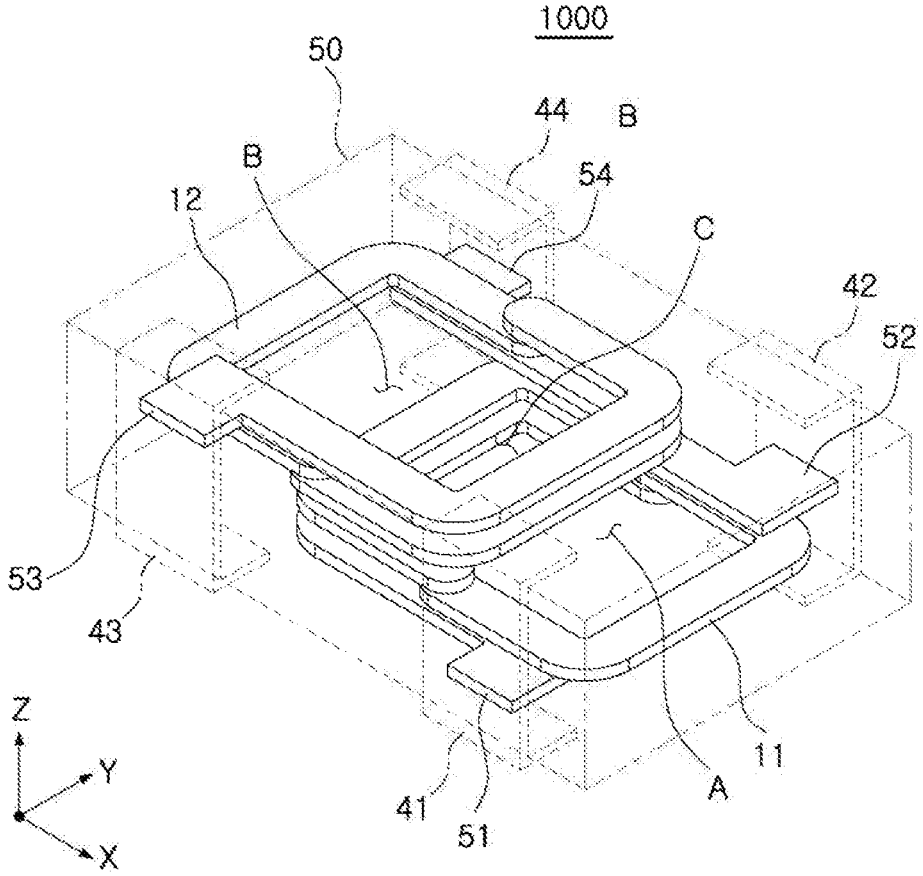
FIG. 8 is a transmission perspective view schematically illustrating a coil portion according to another embodiment of the present disclosure.

FIG. 8 is a transmission perspective view schematically illustrating a coil portion according to another embodiment of the present disclosure.

Figure 9:
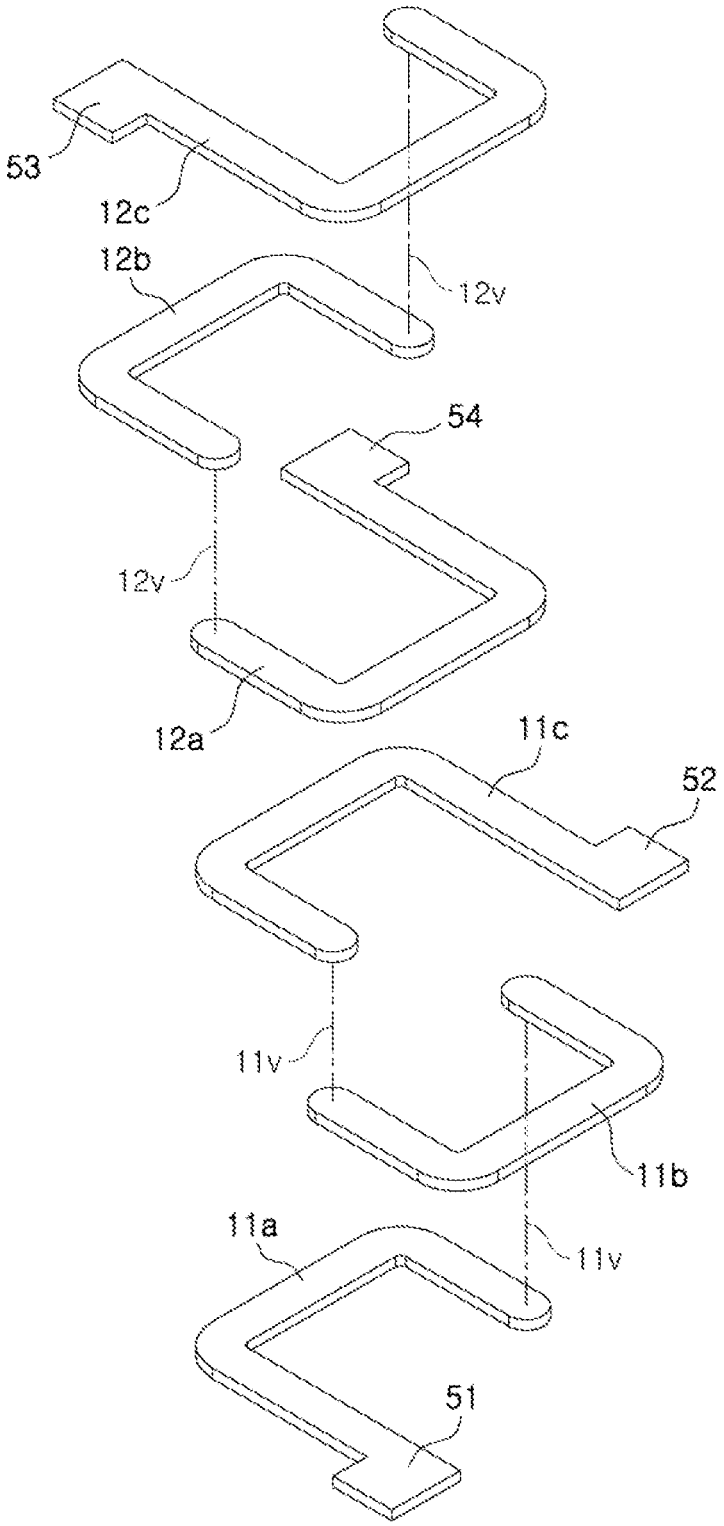
FIG. 9 is an exploded perspective view illustrating a coil portion included in the coil component of FIG. 8.

FIG. 9 is an exploded perspective view illustrating a coil portion included in the coil component of FIG. 8.

Referring to FIGS. 1 to 8, a coil component 10 according to an embodiment of the present disclosure may include a body 50, an insulation layer, coil portions 11 and 12, and external electrodes 41, 42, 43, and 44, and may further include non-shared core portions A and B, a shared core portion C, and a substrate 25.

The body 50 may form appearance of the coil component 10 according to the present embodiment, and the insulation layer may be disposed therein.

The body 50 may be formed in a hexahedral shape as a whole.

Referring to FIG. 1, the body 50 may include a first surface 101 and a second surface 102 facing each other in a longitudinal direction X, a third surface 103 and a fourth surface 104 facing each other in a thickness direction Z, and a fifth surface 105 and a sixth surface 106 facing each other in a width direction Y. Each of the third surface 103 and the fourth surface 104 of the body 50 facing each other may connect the first surface 101 and the second surface 102 of the body 50 facing each other.

The body 50 may include a magnetic material and an insulating resin. Specifically, the body 50 may be formed by stacking one or more magnetic sheets including an insulating resin and a magnetic material dispersed in the insulating resin. In some embodiments, the body 50 may have a structure other than a structure in which the magnetic material is dispersed in the insulating resin. For example, the body 50 may be made of a magnetic material such as ferrite.

The magnetic material may be a ferrite powder or a metal magnetic powder.

Examples of the ferrite powder may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder may include at least one of iron (Fe), silicon (Si), chromium (Cr), cobalt (Co), molybdenum (Mo), aluminum (Al), niobium (Nb), copper (Cu), and nickel (Ni), and alloys thereof. For example, the metal magnetic powder may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metal magnetic powder may be amorphous or crystalline. For example, the metal magnetic powder may be a Fe—Si—B—Cr-based amorphous alloy powder, but is not limited thereto.

The ferrite powder and the metal magnetic powder may have an average diameter from about 0.1 μm to about 30 μm, respectively, but are not limited thereto. As used herein, when the phrase "about" precedes a dimension or quantity, the dimension or quantity following the phrase "about" includes dimensions or quantities greater or smaller than the corresponding dimension or quantity within process variation or measuring variation. Thus, in context of the particular dimension or quantity being referred, the phrase "about" may include values that are, e.g., ±5% or ±10% of the particular dimension or quantity.

The body 50 may include two or more types of magnetic materials dispersed in the insulating resin. In this case, the term "different types of magnetic materials" means that magnetic materials dispersed in an insulating resin are distinguished from each other by an average size, a composition, a crystallinity, and a shape.

The insulating resin may include an epoxy, a polyimide, a liquid crystal polymer, or the like, in a single form or in combined form, but is not limited thereto.

The insulation layers may be disposed inside of the body 50 to be staggered parallel to each other. For example, a first insulation layer 21 disposed inside of the body, and a second insulation layer 22 disposed on the first insulation layer 21 may be included. First coil portion 11 may be disposed on at least one surface of the first insulation layer 21, and second coil portion 12 may be disposed on at least one surface of the second insulation layer 22. Since the second coil portion 12 may be disposed on the first coil portion 11, and the coil portions 11 and 12 may be arranged to be staggered parallel to each other, the first insulation layer 21 may be disposed to be staggered on the second insulation layer 22.

The insulation layer may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the insulation layer may be formed of an insulating material such as prepreg, Ajinomoto Build-up Film (ABF), FR-4, a bismaleimide triazine (BT) film, a photoimageable dielectric (PID) film, and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the insulation layer is formed of an insulating material including a reinforcing material, better rigidity may be provided to the insulation layer. When the insulation layer is formed of an insulating material not containing glass fibers, the insulation layer may be advantageous for thinning a thickness of the entire coil portions 11 and 12. When the insulation layer is formed of an insulating material including a photosensitive insulating resin, the number of processes for forming the coil portions 11 and 12 may be reduced, which may be advantageous in reducing the production cost and may form fine vias.

The coil portions 11 and 12 may be respectively disposed on both surfaces of the insulation layer facing each other, and may exhibit the characteristics of the coil component. For example, when a coil component 10 of an embodiment of the present disclosure is used as a power inductor, the coil portions 11 and 12 may function to stabilize power of an electronic device by storing an electric field as a magnetic field and maintaining an output voltage.

The first coil portion 11 may be disposed inside of the body 50, and the second coil portion 12 may be disposed on the first coil portion 11 in the body 50. In an embodiment of the present disclosure, the first and second coil portions 11 and 12 may be coiled in the same direction, and the first and second coil portions 11 and 12 may be coiled in opposite directions. For example, turn directions of the coil portions 11 and 12 may be the same or different. The coil portions 11 and 12 may have a structure in which a plurality of coil patterns are stacked. For example, the first coil portion 11 may include first and second coil patterns 11*a* and 11*b*, the second coil portion 12 may include third and fourth coil patterns 12*a* and 12*b*. The first and second coil patterns 11*a* and 11*b*, and the third and fourth coil patterns 12*a* and 12*b* may be connected to each other by vias 11*v* and 12*v*, respectively.

The coil portions 11 and 12 and the via may be formed by including a metal having excellent electrical conductivity, and may be formed of silver (Ag), palladium (Pd), aluminum (Al), nickel (Ni), titanium (Ti), gold (Au), copper (Cu), platinum (Pt), alloys thereof, or the like.

The external electrodes 41, 42, 43, and 44 may be disposed outside of the body 50, and may be connected to both ends of the coil portions 11 and 12, respectively. Specifically, the first and second external electrodes 41 and 42 may be disposed outside of the body 50, and may be connected to both ends of the first coil portion 11, respectively. The third and fourth external electrodes 43 and 44 may be disposed outside of the body 50, and may be connected to both ends of the second coil portion 12, respectively. Specifically, the first and second external electrodes 41 and 42 may be connected to the lead-out portions 51, 52, 53, and 54 of the first coil portion 11, respectively, and the third and fourth external electrodes 43 and 44 may be connected to the lead-out portions 51, 52, 53, and 54 of the second coil portion 12, respectively.

As illustrated in FIG. 1, the first and second external electrodes 41 and 42 may be disposed in positions opposite to each other with the first coil portion 11 interposed therebetween, and similarly, the third and fourth external electrodes 43 and 44 may be disposed in positions opposite to each other with the second coil portion 12 interposed therebetween. Therefore, the first external electrode 41 and the third external electrode 43 may be arranged adjacent to each other, and the second external electrode 42 and the fourth external electrode 44 may be arranged adjacent to each other.

The first and third external electrodes 41 and 43 may be input terminals, and the second and fourth external electrodes 42 and 44 may be output terminals, but are not limited thereto. Therefore, electric current input from the first external electrode 41, which may be the input terminal, may flow to the second external electrode 42, which may be the output terminal, through the first coil portion 11. Likewise, electric current input from the third external electrode 43, which may be the input terminal, may flow to the fourth external electrode 44, which may be the output terminal, through the second coil portion 12.

The external electrodes 41, 42, 43, and 44 may be formed using a paste containing a metal having excellent electrical conductivity. For example, the external electrodes 41, 42, 43, and 44 may be a conductive paste containing nickel (Ni), copper (Cu), tin (Sn), silver (Ag), or the like, in a single form, or an alloy thereof, or the like. Further, a plated layer may further be formed on each of the external electrodes 41, 42, 43, and 44. In this case, the plated layer may include one or more selected from the group consisting of nickel (Ni), copper (Cu), and tin (Sn). For example, a nickel (Ni) layer and a tin (Sn) may be sequentially formed.

The core portions A, B, and C may each correspond to one region disposed in the first coil portion 11 and the second coil portion 12 in the body 50. In a coil component according to the embodiment of the present disclosure, since the coil portions 11 and 12 located in upper and lower portions of the body 50 on the basis of a central portion of the body 50 may be formed adjacent to each other while sharing the core portion, the coupling coefficient may be controlled by appropriately increasing or decreasing relative areal ratio of the shared core portion and non-shared core portions.

Therefore, leakage inductance and mutual inductance may be controlled and realized to desired values. When the coupling coefficient is a value close to 1, the coupling coefficient may be relatively large, and the (−) sign means a negative coupling.

Specifically, the first coil portion 11 may have first core portions A and C, and the second coil portion 12, disposed on the first coil portion 11, may have second core portions B and C. Referring to FIGS. 1 to 4, the first core portions A and C may include a first shared core portion C overlapping the second core portion C, and a first non-shared core portion A not overlapping the second core portions B and C, when viewed from an upper portion of the first coil portion 11; and the second core portions B and C may include a second shared core portion C overlapping the first core portion C, and a second non-shared core portion B not overlapping the first core portions A and C, when viewed from an upper portion of the second coil portion 12.

In an embodiment of the present disclosure, a case in which an area of the first and second shared core portions C is larger than an area of each of the first and second non-shared core portions A and B, respectively, may be included. As the area of the core portion shared between the two coil portions 11 and 12 increases, the mutual inductance may increase and the coupling coefficient (k) may increase. Also, a case in which an area of the first and second shared core portions C is smaller than an area of each of the first and second non-shared core portions A and B, respectively, may be included. As the area of the non-shared core increases, the leakage inductance may increase, thereby decreasing the coupling coefficient (k).

In the conventional coupled inductor, the coupling coefficient may be controlled by using a thickness between the coil portions 11 and 12, arranged in a vertical direction. There may be a limit in reducing the thickness of the coil component. When a gap between the coil portions 11 and 12 increases, there may be a problem in that a size of the component increases. In the present embodiment, the coupling coefficient (k) may be controlled without increasing the mounting area in the X-Y plane having a relatively large spatial margin, by controlling the relative area ratio of the core portions C shared by the coil portions 11 and 12, and the core portions A and B not shared by the coil portions 11 and 12.

Manufacturing Method of Coil Component

The insulation layer may be applied in all cases as long as thin film type members have an insulating property. For example, the insulation layer may be a prepreg (ppg), or a conventional copper clad laminate from which upper and lower copper foil layers are removed. The specific thickness thereof is not limited, and it may be sufficient when a support function is suitably performed. For example, in order to utilize the existing facilities as they are, it is preferable that the thickness be about 60 μm.

Next, a copper foil layer may be formed on an insulation layer, and may be usually made of copper (Cu), although it is not limited as long as it is a material having electrical conductivity. There is no limitation on a method of forming the copper foil layer, and it may be a chemical plating method or a sputtering method, and may be appropriately selected by a person skilled in the art, depending on the process conditions and the required specifications.

An insulation resist may be disposed on the copper foil layer, and the resist may be derived by exposing/developing a dry film having a predetermined thickness to have a coil-shaped pattern. The insulation resist may be removed to form coil patterns 11*a*, 11*b*, 12*a*, and 12*b*, and vias, having a spiral shape as a whole.

Next, an insulation layer may be separately separated to form a plurality of bodies 50. As a result, at least two bodies 50 may be formed on upper and lower portions of the insulation layer. Therefore, it may be advantageous to improve symmetry and yield between the bodies 50.

Then, through-holes penetrating a central portion of the body 50 may be processed, and the inside of the through-hole and the inside of the body 50 may be filled with a magnetic material, to seal the entire coil portions 11 and 12.

Second Embodiment

Referring to FIGS. 6 and 7, a coil component 100 according to the present embodiment may further include a substrate 25 between two coil portions 11 and 12, compared with the coil component 10 according to the first embodiment of the present disclosure. Therefore, in describing the present embodiment, only the substrate 25 different from the first embodiment will be described. The remaining configuration of the present embodiment may be applied, as it is in the first embodiment of the present disclosure.

The substrate 25 may be disposed between the first coil portion 11 and the second coil portion 12 to support the coil portions 11 and 12. In an embodiment of the present disclosure, the substrate 25 may include a third region overlapping first and second shared core portions, a first region overlapping a first non-shared core portion, and a second region overlapping a second non-shared core portion. The substrate 25 may have three separate regions A1, B1, and C1, corresponding to each of the core portions A, B, and C of the first and second coil portions 11 and 12. The substrate 25 may further include end portions 61, 62, 63, and 64 extending to a fifth surface and a sixth surface of a body 50. Each of the end portions 61, 62, 63, and 64 may be arranged to be spaced apart from each other on a plane parallel to a third surface 103 of the body 50. The end portions 61, 62, 63, and 64 may be shapes corresponding to lead-out portions 51, 52, 53, and 54 of the coil portions 11 and 12, and may be arranged to be spaced apart from each other in a direction parallel to the lead-out portions 51, 52, 53, and 54, and a fifth surface 105 of the body 50. The first and second end portions 61 and 62 may be shapes corresponding to the first and second lead-out portions 51 and 52 of the first coil portion 11, respectively, and may be arranged to be spaced apart from the first and second lead-out portions 51 and 52. The third and fourth end portions 63 and 64 may be shapes corresponding to the third and fourth lead-out portions 53 and 54 of the second coil portion 12, and may be arranged to be spaced apart from the third and fourth lead-out portions 53 and 54.

The substrate 25 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the substrate 25 may be formed of an insulating material such as prepreg, Ajinomoto Build-up Film (ABF), FR-4, a bismaleimide triazine (BT) film, a photoimageable dielectric (PID) film, and the like, but is not limited thereto.

The substrate 25 may also be formed of a copper clad laminate. In this case, a sheet in which insulating material such as paper or glass fiber may be impregnated with insulating resin may be stacked several times, and then copper foil (Cu) may be bonded. In an embodiment of the present disclosure, by using the copper clad laminate as the substrate 25, the coupling with the first and second coil portions 11 and 12 may be facilitated, to enhance function of supporting the coil.

The following Table 1 illustrates an experimental example in which values of coupling coefficient (k) according to an area of a shared core portion(s) may be compared in an embodiment of the present disclosure. In Comparative Example 1 and Comparative Example 2, values of the coupling coefficient (k) were measured by varying an area of a shared core portion(s).

TABLE 1

| Comparative Example | Area of Shared Core Portion ($mm^2$) | Coupling Coefficient (k) |
|---|---|---|
| 1 | 0.7323 | −0.26668 |
| 2 | 1.3803 | −0.46719 |

As can be seen from the experimental results in Table 1, the absolute value of the coupling coefficient increased, as the area of the shared core portion C of the coupled inductor increases. As the area of the core portion C shared between the two coil portions 11 and 12 increases, the mutual inductance increases, thereby increasing the coupling coefficient (k). As the area of the shared core portion C decreases, the leakage inductance increases, thereby decreasing the coupling coefficient (k). According to an embodiment of the present disclosure, the inductor current ripple may be effectively controlled, without increasing the mounting area, by controlling the relative area ratio of the shared core portion C and the non-shared core portions A and B.

Manufacturing Method of Coil Component

Referring to FIGS. 6 and 7, the substrate 25 may be further disposed between the first and second coil portions 11 and 12. Due to the presence of the substrate 25, the thin film type coil component 100 of the present disclosure has three separate regions overlapping the three core portions, as compared to the conventional thin film type coil component.

Referring to FIG. 6, the coil portions 11 and 12 may be supported by the substrate 25. The first coil portion 11 may be formed on one surface of the substrate 25, and the second coil portion 12 may be formed on the other surface of the substrate 25, facing the one surface of the substrate 25. The first and second coil portions 11 and 12 may be formed to be arranged alternately to each other on both surfaces of the substrate 25, because the second coil portion 12 may be disposed on the first coil portion 11 in parallel with each other. The first insulation layer 21 may be formed on a first coil pattern 11*a* of the first coil portion 11, and the second insulation layer 22 may be formed on a third coil pattern 12*a* of the second coil portion 12, to surround the first and second coil portions 11 and 12 by the insulation layers, respectively. After the formation of the insulation layer, a second coil pattern 11*b* may be formed on the first coil pattern 11*a*, and a fourth coil pattern 12*b* may be formed on the third coil pattern 12*a*.

Thereafter, a first via may be formed in the first insulation layer 21 to electrically connect the first coil pattern 11*a* of the first coil portion 11 to the second coil pattern 11*b*. A second via may be formed in the second insulation layer 22 to electrically connect the third coil pattern 12*a* of the second coil portion 12 to the fourth coil pattern 12*b*. Therefore, a coil pattern surrounded by an insulation layer and electrically connected may be formed on both surfaces of the substrate 25.

The substrate 25 on which the coil portions 11 and 12 are formed on both surfaces may be trimmed into three separate regions A1, B1, and C1, and, for example, may be separated as a third region C1 overlapping the core portion in which the first and second coil portions 11 and 12 overlap each other, a first region A1 overlapping the first non-shared core portion A, and a second region B1 overlapping the second non-shared core portion B, respectively.

As illustrated in FIG. 6, since the second coil portion 12 is disposed on the first coil portion 11 to be staggered parallel to each other, a region in which a coil pattern is not formed on each of the first and second insulation layers 21 and 22 may occur. An operation of removing an insulation layer in which the coil pattern is not disposed in the trimming operation may be also performed.

After the trimming operation, a magnetic sheet including the metal magnetic powder may be filled to form the body 50.

Third Embodiment (Stacked Coil Component)

Referring to FIGS. 8 and 9, a coil component 1000 according to the present embodiment may be manufactured in a thin film type according to the first embodiment of the present disclosure, but may also be manufactured in a stack type. Therefore, in describing the present embodiment, only the stack coil component different from the first embodiment will be described. The remaining configuration of the present embodiment may be applied, as it is in the first embodiment of the present disclosure.

Another embodiment of the present disclosure may provide a coil component comprising a ceramic body 50 in which an insulation sheet is stacked.

The ceramic body 50 may be formed by stacking a plurality of insulation sheets. The plurality of insulation sheets for forming the ceramic body 50 may be sintered, and may be integrated in a degree to be difficult to confirm without using a scanning electron microscope (SEM). The ceramic body 50 may have a hexahedronal shape, and the ceramic body 50 may include a known ferrite such as an $Al_2O_3$-based dielectric, or Mn—Zn-based ferrite, Ni—Zn-based ferrite, Ni—Zn—Cu-based ferrite, Mn—Mg-based ferrite, Ba-based ferrite, Li-based ferrite, and the like.

The coil portions 11 and 12 may be formed by electrically connecting internal coil patterns 11*a*, 11*b*, 11*c*, 12*a*, 12*b* and 12*c*, formed by printing a conductive paste containing a conductive metal in a predetermined thickness, to a plurality of insulation sheets forming the ceramic body 50. Vias (11*v* and 12*v*) may be formed at predetermined positions in the respective insulation sheets on which the coil patterns 11*a*, 11*b*, 11*c*, 12*a*, 12*b* and 12*c* are printed, and the internal coil patterns 11*a*, 11*b*, 11*c*, 12*a*, and 12*c* may be electrically connected to each other, to form a single coil.

The stacked body 50 may include a magnetic body. For example, the body 50 may include Mn—Zn-based ferrite, Ni—Zn-based ferrite, Ni—Zn—Cu-based ferrite, Mn—Mg-based ferrite, Ba-based ferrite, Li-based ferrite, and the like, and may include a variety of known magnetic bodies.

The conductive metal forming the coil patterns 11*a*, 11*b*, 11*c*, 12*a*, 12*c* and 12*c* is not particularly limited as long as it is a metal having excellent electric conductivity, and, for example, may be silver (Ag), palladium (Pd), aluminum (Al), nickel (Ni), titanium (Ti), gold (Au), copper (Cu), platinum (Pt), or the like, in a single form, or alloys thereof. Copper (Cu) may be used most preferably, when both the improvement of the electrical conductivity and the reduction of the manufacturing cost are taken into consideration.

Two internal coil patterns 11*a*, 11*b*, 12*a*, and 12*b*, among the plurality of coil patterns 11*a*, 11*b*, 11*c*, 12*a*, 12*b* and 12*c* forming the coil portions 11 and 12, may include the lead-out portions 51, 52, 53, and 54 leading out to the outside of the stacked body 50 to be connected to the stack body 50, to be connected to the outer electrodes 41, 42, 43, and 44.

The present disclosure is not limited by the above-described embodiments and the accompanying drawings, but is intended to be limited only by the appended claims.

The coil component according to an embodiment of the present disclosure may adjust the coupling coefficient and the leakage inductance by controlling the area and permeability of the core portion shared by the two coil portions disposed inside of the body.

In addition, through the above, the leakage inductance and the mutual inductance may be controlled to desired values.

While example embodiments have been illustrated and described above, it will be apparent to those skilled in the art that modifications and variations could be made without departing from the scope of the present disclosure as defined by the appended claims.

What is claimed is:

1. A coil component comprising:

a body;

a first coil portion disposed inside of the body and having a first core portion;

a first external electrode and a second external electrode disposed outside of the body and connected to both ends of the first coil portion, respectively;

a second coil portion disposed on the first coil portion in the body and having a second core portion;

a third external electrode and a fourth external electrode disposed outside of the body and connected to both ends of the second coil portion, respectively; and a substrate disposed between the first coil portion and the second coil portion, wherein the first core portion comprises a first shared core portion overlapping the second core portion and a first non-shared core portion not overlapping the second core portion, the second core portion comprises a second shared core portion overlapping the first core portion and a second non-shared core portion not overlapping the first core portion, and wherein the substrate comprises a first region overlapping the first non-shared core portion, a second region overlapping the second non-shared core portion, and a third region overlapping the first and second shared core portions.

2. The coil component according to claim 1, wherein an area of the first and second shared core portions is larger than an area of each of the first and second non-shared core portions.

3. The coil component according to claim 1, wherein an area of the first and second shared core portions is smaller than an area of each of the first and second non-shared core portions.

4. The coil component according to claim 1, wherein each of the first and second coil portions has a structure in which a plurality of coil patterns are stacked.

5. A coil component comprising:

a body;

a first insulation layer disposed inside of the body, and a second insulation layer disposed on the first insulation layer;

a first coil portion disposed on at least one surface of the first insulation layer and having a first core portion;

a first external electrode and a second external electrode disposed outside of the body and connected to both ends of the first coil portion, respectively;

a second coil portion disposed on at least one surface of the second insulation layer, disposed on the first coil portion, and having a second core portion;

a third external electrode and a fourth external electrode disposed outside of the body and connected to both ends of the second coil portion, respectively; and a substrate disposed between the first coil portion and the second coil portion, wherein the first core portion comprises a first shared core portion overlapping the second core portion and a first non-shared core portion not overlapping the second core portion, the second core portion comprises a second shared core portion overlapping the first core portion and a second non-shared core portion not overlapping the first core portion, and wherein the substrate comprises a first region overlapping the first non-shared core portion, a second region overlapping the second non-shared core portion, and a third region overlapping the first and second shared core portions.

6. The coil component according to claim 5, wherein an area of the first and second shared core portions is larger than an area of each of the first and second non-shared core portions.

7. The coil component according to claim 5, wherein an area of the first and second shared core portions is smaller than an area of each of the first and second non-shared core portions.

8. The coil component according to claim 5, wherein each of the first and second coil portions has a structure in which a plurality of coil patterns are stacked.

9. A coil component comprising:

a ceramic body in which an insulation sheet is stacked;

a first coil portion disposed inside of the body and having a first core portion;

a first external electrode and a second external electrode disposed outside of the body and connected to both ends of the first coil portion, respectively;

a second coil portion disposed on the first coil portion in the body and having a second core portion;

a third external electrode and a fourth external electrode disposed outside of the body and connected to both ends of the second coil portion, respectively;

a substrate disposed between the first coil portion and the second coil portion, wherein the first core portion comprises a first shared core portion overlapping the second core portion and a first non-shared core portion not overlapping the second core portion, when viewed from an upper portion of the first coil portion, the second core portion comprises a second shared core portion overlapping the first core portion and a second non-shared core portion not overlapping the first core portion, when viewed from an upper portion of the second coil portion, and wherein the substrate comprises a first region overlapping the first non-shared core portion, a second region overlapping the second non-shared core portion, and a third region overlapping the first and second shared core portions.

10. A coil component, comprising:

a first coil having a first end connecting to a first external electrode and a second end connected to a second external electrode, and a first core comprising a first shared core portion and a first non-shared core portion;

a second coil having a third end connecting to a third external electrode and a fourth end connected to a fourth external electrode, and a second core comprising a second shared core portion and a second non-shared core portion, and a substrate disposed between the first coil portion and the second coil portion, wherein the second coil is disposed on the first coil such that the first and second shared core portions overlap with each other, the first non-shared core portion is spaced apart from the second core and the second non-shared core portion is spaced apart from the first core, wherein the substrate comprises a first region overlapping the first non-shared core portion, a second region overlapping the second non-shared core portion, and a third region overlapping the first and second shared core portions, and wherein the first and second coils are enclosed in a body.

11. The coil component of claim 10, wherein the area of the first and second shared core portions is greater than either of the first non-shared core portion and the second non-shared core portion.

12. The coil component of claim 10, wherein each of the first and second coils comprises a plurality of coil turns.

13. The coil component of claim 10, wherein each of the first and second coils comprises coil turns are disposed on a stack of insulating layers and connected by a via penetrating through the stack.

14. The coil component of claim 10, wherein an insulating layer is disposed between the first coil and the second coil.

15. The coil component of claim 10, wherein the first and second shared core portions and the first and second non-shared core portions comprise a material including an insulating resin and a magnetic powder.

16. The coil component of claim 10, wherein the body comprises stacked ceramic sheets, and the first and second coils include conductive patterns printed on the ceramic sheets.

17. The coil component of claim 10, wherein the first and third external electrodes are disposed to be spaced apart on a first surface of the body, and the second and fourth external electrodes are disposed to be spaced apart on a second surface of the body.

18. The coil component of claim 10, wherein the body comprises a material including an insulating resin and a magnetic powder.

* * * * *